United States Patent [19]

Hayashi et al.

[11] Patent Number: 5,017,935

[45] Date of Patent: May 21, 1991

[54] MULTIBAND ANTENNA SYSTEM FOR USE IN MOTOR VEHICLES

[75] Inventors: Akihiko Hayashi, Oogaki; Toru Yamazaki, Chiryu; Akira Torii, Nagoya, all of Japan

[73] Assignee: Nippondenso Co., Ltd., Kariya, Japan

[21] Appl. No.: 497,851

[22] Filed: Mar. 23, 1990

[30] Foreign Application Priority Data

Mar. 23, 1989 [JP] Japan ..... 1-71313

[51] Int. Cl.[5] ..... H01Q 1/100; H01Q 1/320; H01Q 1/000; H01Q 1/500

[52] U.S. Cl. ..... 343/715; 343/722; 343/858; 343/901

[58] Field of Search ..... 343/7 B, 715, 722, 745, 343/749, 850, 858, 864, 901, 905, 906

[56] References Cited

U.S. PATENT DOCUMENTS

| | | | |
|---|---|---|---|
| 3,725,942 | 4/1973 | Ukmar | 343/715 |
| 4,647,941 | 3/1987 | Myer | 343/792 |
| 4,675,687 | 6/1987 | Elliott | 343/715 |
| 4,748,450 | 5/1988 | Hines et al. | 343/715 |
| 4,850,034 | 7/1989 | Campbell | 343/715 |

FOREIGN PATENT DOCUMENTS

| | | |
|---|---|---|
| 0173801 | 7/1987 | Japan . |
| 0179202 | 8/1987 | Japan . |
| 0047041 | 12/1988 | Japan . |

OTHER PUBLICATIONS

"AM-MF-Mobile Telephone Combined Tri-Bandantenna for Vehicles", by K. Taniyoshi et al; Fujitsu Ten Technical Report, Apr. 1989, vol. 7, No. 1.

*Primary Examiner*—Michael C. Wimer
*Assistant Examiner*—Peter Toby Brown
*Attorney, Agent, or Firm*—Cushman, Darby & Cushman

[57] ABSTRACT

A multiband antenna system for use in a motor vehicle comprising an antenna unit responsible for first and second frequency bands. The antenna unit is electrically coupled to a first conduit tube which is in turn coupled coaxially to a second conduit tube with a capacitor being interposed therebetween. The capacitor is arranged so as to act as a short with respect to the first frequency signal and act as an open for the second frequency signal. The first conduit tube is connected to a first feeding terminal for deriving the second frequency signal and the second conduit tube is coupled to a second feeding terminal to derive the first frequency signal. This antenna system is constructed by using only one antenna unit having a predetermined length, thereby allowing simplification of the arrangement of the antenna system for easy manufacturing.

14 Claims, 7 Drawing Sheets

MULTIBAND ANTENNA SYSTEM FOR USE IN MOTOR VEHICLES

BACKGROUND OF THE INVENTION

The present invention relates generally to multiband antenna systems for use in motor vehicles, and more particularly to a multiband antenna system suitable for reception of AM/FM radio signals and further for quasi-microwave communication, for example.

In order to meet the recent requirement for using motor vehicles as mobile stations, various types of multiband antenna systems suitable for quasi-microwave communication (radiotelephony) concurrent with reception of AM/FM radio signals have been proposed as exemplified by Japanese Patent provisional Publication Nos. 62-179202 and 61-502579. FIGS. 1A and 1B show a basic arrangement of the multiband antenna system disclosed in the aforementioned Japanese Patent Provisional Publication No. 62-179202. As illustrated in FIGS. 1A and 1B, the prior art multiband antenna system is of the cellular telephone type for use in motor vehicles and comprises a first antenna element 1 having a length of one-quarter wavelength at the telephone band center frequency and acting as a monopole antenna unit in association with vehicle ground plane 11, a phasing coil 2 having an electrical length of three-half wavelength or one-half wavelength at the telephone band center frequency, a second antenna element 3 having a length corresponding to one-half wavelength at the telephone band center frequency and functioning as a dipole antenna unit, a third antenna element 5 and another coil 4 adapted to resonate at the telephone band center frequency so as to prevent currents inducted in the aforementioned first antenna element 1, phasing coil 2 and second antenna element 3 from flowing into the third antenna element 5, whereby the entire gain is increased up to the standard dipole antenna ratio 3dB. In addition, for reception of the radio signals, the conventional antenna system resonates with respect to the FM band center frequency with the entire physical length of the respective antenna elements and the respective coils and further acts as a capacitor antenna for the AM band with the apparent length of the respective antenna elements and the respective coils. The respective currents caused thereby are mixed and introduced through a coaxial tube 6, encased in an antenna encasing tube 12 and a feeder distribution center 7 into a branching filter 8 having a telephone terminal 9 and an AM/FM terminal 10. Illustrated at numeral 14 is a motor system which allows extension and retraction of the antenna unit from and into the antenna encasing tube 12.

FIG. 2 illustrates a basic arrangement of the prior art multiband antenna system disclosed in the above-mentioned Japanese Patent Provisional Publication No. 61-502579. The multiband antenna system comprises a cellular telephone antenna element 20 including a sleeve antenna section having a length equal to one-half the wavelength at the telephone band center frequency and a radio wave reception antenna element 21 having a length equal to one-quarter of the wavelength at the FM band center frequency and acting as a monopole antenna by protruding from a vehicle body ground plane 22. The telephone antenna element 20 and the radio wave reception antenna element 21 are telescopically arranged, and in the extension state, the telephone antenna element 20 is provided at the upper end of the radio wave reception antenna element 21 in order to eliminate electrical interference from the vehicle body 22. A feed cable 23, together with an extention and retraction cable 25, extends through the inside of the radio wave reception antenna 21 and an antenna encasing tube 24 and is taken up by a take-up section 27 of a motor driving mechanism 26 and coupled through a telephone output terminal 28 to a telephone terminal 29. Further, the radio wave reception antenna element 21 is electrically connected to an inner conductive tube 30 located in the antenna encasing tube 24 and coupled to a radio receiver 32 through a radio output terminal 31 provided at a portion of the antenna encasing tube 24.

An important problem in such multiband antenna systems constructed by a combination of independent antenna elements relates to deterioration of the antenna performance due to the mutual synergistic interference. One possible solution is that the independent antenna elements are arranged up and down in insulating relation to each other so as to eliminate the interference to each other or that a concentrated constant circuit is provided therebetween to prevent unnecessary leakage currents. However, this arrangement causes a complex structure and difficulty of the characteristic adjustment so as to lower the productivity.

SUMMARY OF THE INVENTION

It is therefore an object of the present invention to provide a multiband antenna system which is capable of eliminating deterioration of the antenna performance resulting from the mutual synergistic interference and simplifying its structure to improve the productivity.

With this and other objects which will become apparent as the description proceeds, according to the present invention, a multiband antenna system for use in a motor vehicle comprises an antenna section protrusively provided on the motor vehicle and having a predetermined length so as to be responsive to a first frequency band and a second frequency band different from the first frequency band. The antenna section is electrically coupled to a first conduit tube for effecting transmission of first and second frequency signals induced by the antenna section in response to said first and second bands. The first conduit tube is coaxially arranged with a second conduit tube having substantially the same diameter as the first conduit tube. Also included in the multiband antenna system is capacitor means provided between the first and second conduit tubes, the capacitor means acting as a short with respect to the first frequency signal and acting as an open with respect to the second frequency signal. The first and second conduit tubes are coaxially enclosed by a third conduit tube electrically coupled to a body of the motor vehicle and having a length equal to the sum of the lengths of the first and second conduit tubes. First feeding means is connected to the first conduit tube for deriving the second frequency signal and second feeding means is connected to said second conduit tube for deriving the first frequency signal.

BRIEF DESCRIPTION OF THE DRAWINGS

The present invention will be described in further detail with reference to the accompanying drawings, in which.

DETAILED DESCRIPTION OF THE INVENTION

Figure 1A:
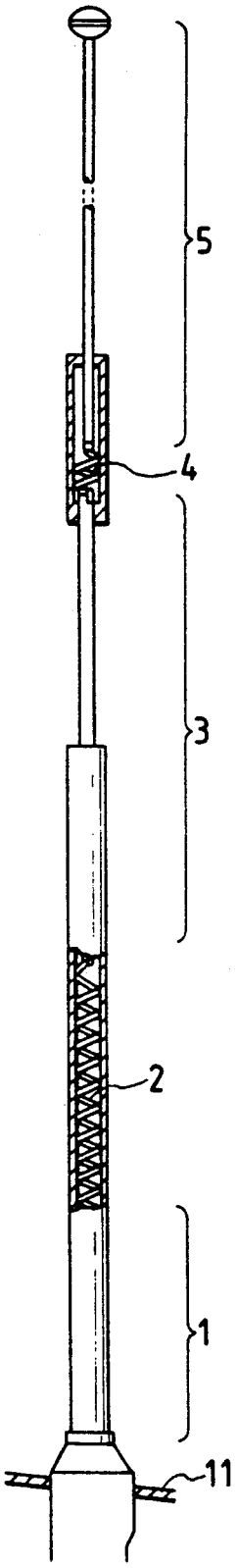
FIG. 1A PRIOR ART
FIGS. 1 and 2 are illustrations for describing prior art multiband antenna systems.
Figure 1B:
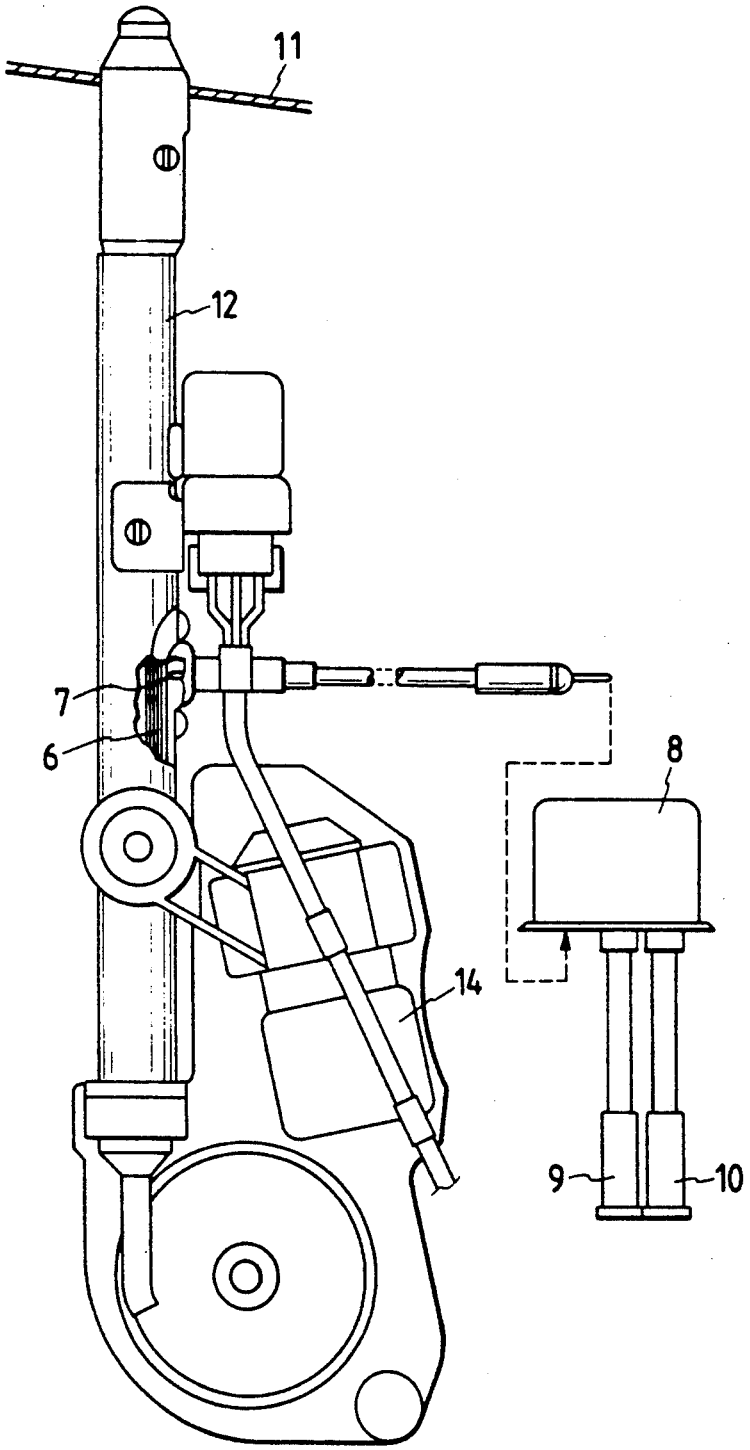
FIG. 1B PRIOR ART
Figure 2:
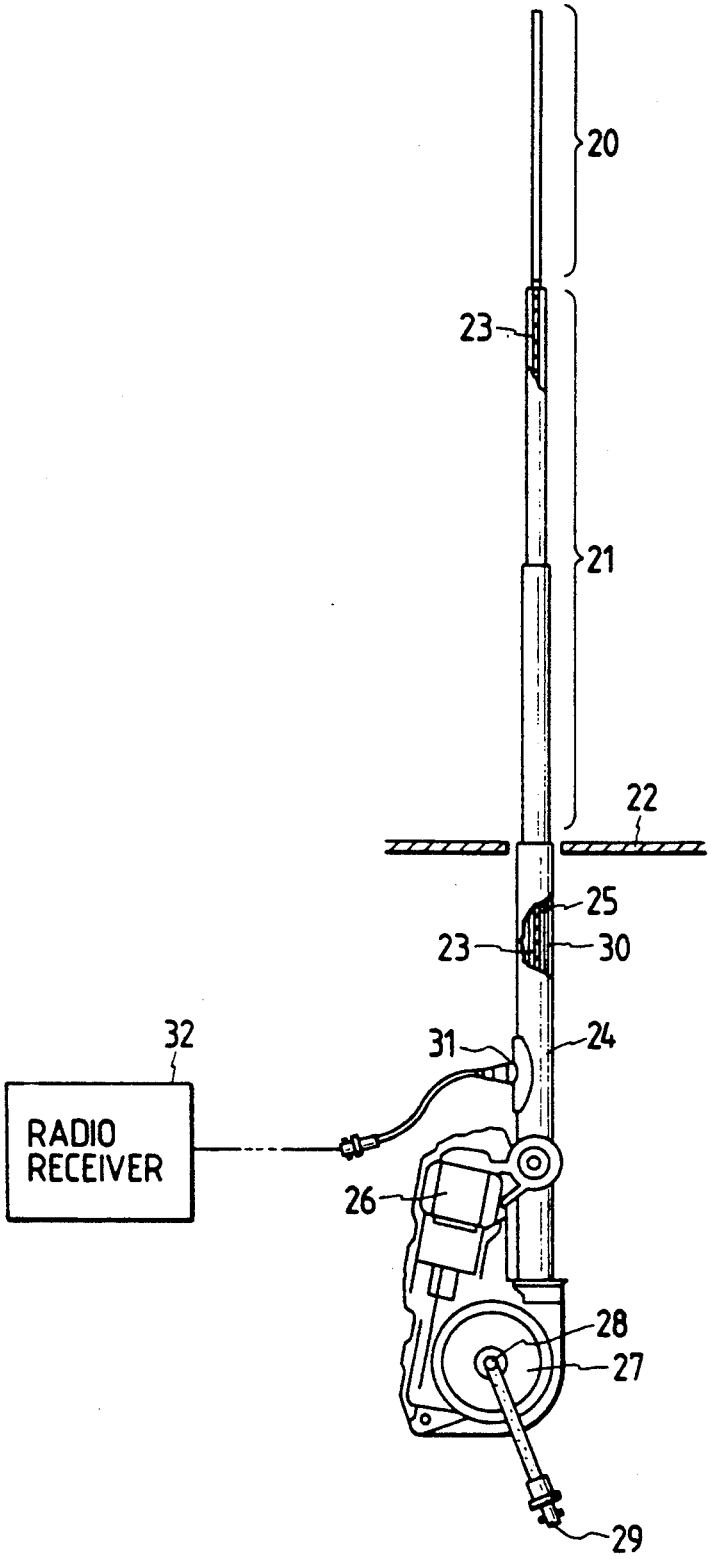
FIG. 2 PRIOR ART
Figure 3:
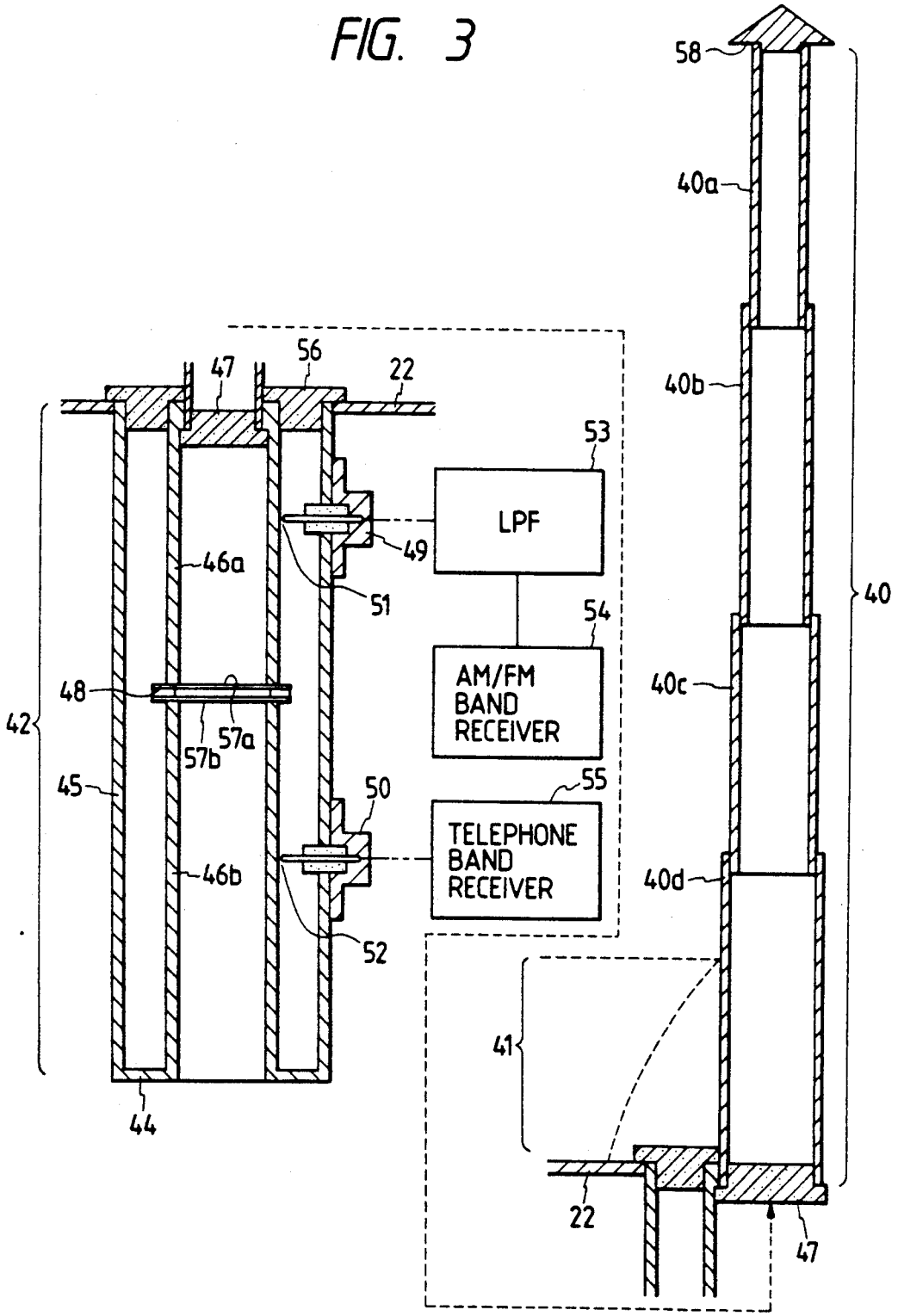
FIG. 3 is a cross-sectional view showing a multiband antenna system according to an embodiment of the present invention.

Referring now to FIG. 3, there is illustrated a multiband antenna system according to the present invention. In FIG. 3, the multiband antenna system includes an antenna unit 40 which is available as a radio wave reception antenna and which comprises a plurality of elements 40*a* to 40*d* which are telescopically and coaxially coupled to each other so as to allow extension and retraction. Here, when the wavelength at the center frequency in the telephone band (first frequency band) is taken as $\lambda_{TEL}$, the length of the antenna unit 40 is determined to be $n.\lambda_{TEL}+\frac{1}{4}\lambda_{TEL}$ (n=1, 2, 3) or $n.\lambda_{TEL}=\frac{3}{8}\lambda_{TEL}$ (n=1, 2, 3) when the vertical-plane radiation pattern assumes the horizontal direction, whereby the material radiation section 41 acts as a $\frac{1}{4}\lambda_{TEL}$ or $\frac{3}{8}\lambda_{TEL}$ vertical antenna Further, when the wavelength at the center frequency in the FM band of the radio wave band (second frequency band) is taken to be $\lambda_{FM}$, the length of the antenna unit 40 becomes about $\frac{1}{4}\lambda_{FM}$, and therefore the antenna unit 40 can be used as a $\frac{1}{4}\lambda_{FM}$ monopole antenna.

Figure 4A:
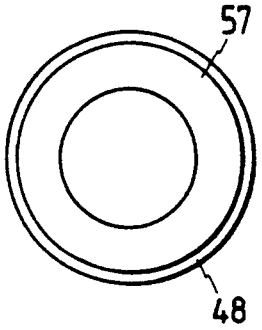
FIGS. 4A and 4B show one example of an insulator to be used in the FIG. 3 multiband antenna system.
Figure 4B:
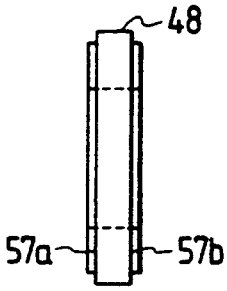

At the top portion of the antenna unit 40 is provided an antenna top 58 which is for the purpose of preventing the antenna unit 40 from being dropped in first and second inner conduit tubes 46*a* and 46*b* of a coaxial feeder tube 42 which functions as an encasing tube. The coaxial feeder tube 42 comprises the first and second inner conduit tubes 46*a*, 46*b*, coaxially arranged vertically and acting as first and second transmission passages, and an outer conduit tube 45. The first inner conduit tube 46*a* is electrically coupled to the antenna unit 40 and the second inner conduit tube 46*b* and the inner conduit tube 45 is shorted through a lower-end short portion 44. In addition, the outer conduit tube 45 is coupled electrically to a vehicle ground plane 22. The first and second inner conduit tubes 46*a* and 46*b* are separated from each other by means of an insulator 48 so as to be electrically insulated from each other. As illustrated in FIGS. 4A and 4B, the insulator 48, being tightly inserted into a space formed between the first and second inner conduit tubes 46*a* and 46*b*, has a hollow cylindrical configuration, or a ring-like shape, and has at its both side surfaces electrode plates 57*a* and 57*b* so as to act as a dielectric device. The insulator 48 functions as a capacitor and operates as a high-pass filter. That is, the insulator 48 is arranged to have a capacity so as to be a short with respect to the telephone band frequency and be an open with respect to the radio wave band (AM/FM band).

Figure 5A:
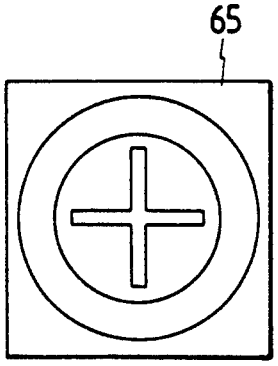
FIGS. 5A to 5C are illustrations of different insulators also usable in the FIG. 3 multiband antenna system.
Figure 5B:
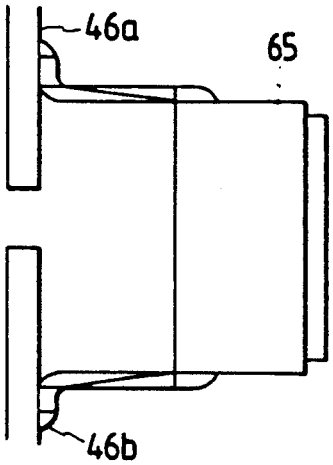
Figure 5C:
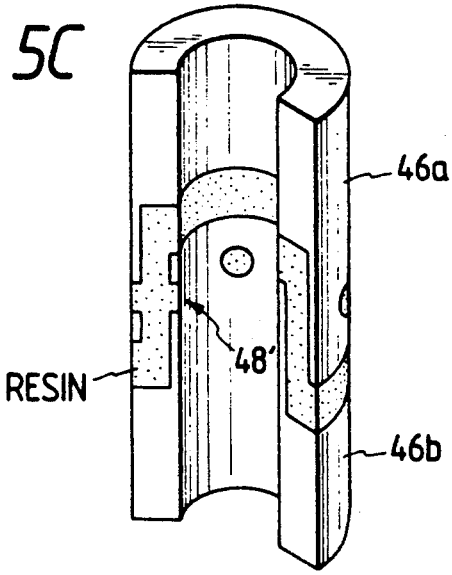

FIGS. 5A and 5B show a trimmer capacitor 65 which is used instead of the insulator 48 as illustrated in FIGS. 4A and 4B. The provision of the trimmer capacitor 65 allows adjustment of the AM/FM band insertion loss and the isolation from the telephone band and further permits fine adjustment of the voltage standing wave ratio (VSWR). Further, FIG. 5C shows a resin-coupling type insulator 48'. As illustrated in FIG. 5C, the insulator 48' is constructed by forming surfaces of the first and second inner conduit tubes 46*a* and 46*b* which face each other and inserting a desirable resin therebetween. The capacity depends upon the areas of the surfaces thereof. This arrangement causes reduction of the electrical loss, and further permits decrease in the impact force due to the extension and retraction operation of the antenna unit 40 so as to improve the durability of the multiband antenna system.

Returning again to FIG. 3, the first and second inner conduit tubes 46*a* and 46*b* work as an encasing tube for encasing the antenna unit 40, and at the lower portion of the antenna unit 40 is provided a stopper 47 which allows smooth encasing of the antenna unit 40 in the first and second inner conduit tubes 46*a* and 46*b* and further prevents the antenna unit 40 from falling out therefrom. The coaxial feeder tube 42 is fixedly secured to the vehicle body through a fixing member 56 which is made of a material permitting insulation of the antenna unit 40 from the vehicle body plane 22.

Figure 6:
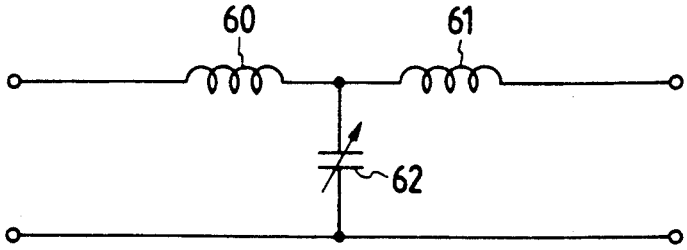
FIG. 6 is a circuit diagram showing an arrangement of a low-pass filter used in the FIG. 3 antenna system.

AM/FM band reception power caused by the antenna unit 40 is derived from an AM/FM terminal feeding point 51 of the first inner conduit tube 46*a* and supplied through an AM/FM terminal 49 attached to the outer conduit tube 45 to a low-pass filter (LPF) 53. At this time, the insulator 48 is in the blocking state with respect to the FM band frequency, thereby preventing the FM band reception power from being leaked as unnecessary currents through the second inner conduit tube 46*b*, short portion 44 and outer conduit tube 45 to the vehicle ground plane 22 so as to obtain the maximum power from the AM/FM terminal 49. The low-pass filter (LPF) 53, as illustrated in FIG. 6, comprises coils 60 and 61 and a variable capacitor 62 so as to pass the AM/FM band frequency signal and acts as a concentrated constant circuit or a distributed constant circuit for cutting off the telephone band frequency signal. The LPF 53 is arranged so as to limit the insertion loss in the FM band up to below 0.2 dB and limit the isolation (attenuation amount) from the telephone band up to below −60 dB. Thus, after passing through the LPF 53, the AM/FM band reception power is led to an AM/FM band receiver 54. Further, the telephone reception power due to the antenna unit 40 is derived from a telephone terminal feeding point 52 on the second inner conduit tube 46*b* and supplied to a telephone band receiver 55. Here, at this time, since the distance from the AM/FM terminal feeding point position 51 to the LPF 53 cannot be disregarded with respect to the wavelength $\lambda_{TEL}$ of the telephone band center frequency, the input point of the LPF 53 is preferably set to be in the blocking state in terms of the telephone band. Accordingly, the distance from the AM/FM terminal feeding point position 51 to the input point of the LPF 53 is determined to be a length corresponding to one-quarter wavelength of the wavelength $\lambda_{TEL}$ at the telephone band center frequency.

Figure 7:
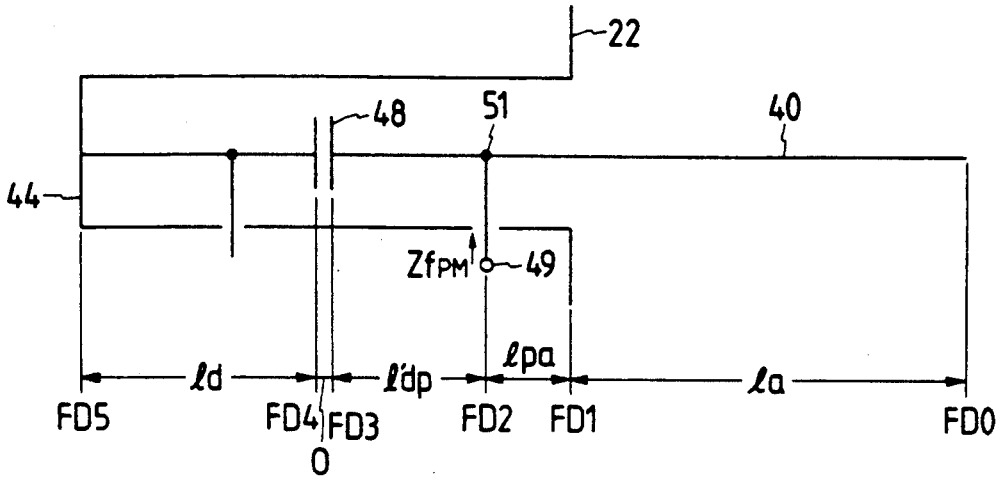
FIGS. 7 and 8 are illustrations for describing determination of feeding points with respect to first and second frequency signals.

A description will be made hereinbelow in terms of an arrangement of the coaxial feeder tube 42 and the feeding point position for causing the maximum reception power due to the antenna unit 40 to be supplied to the receiver side with reference to FIGS. 7 and 8. In FIG. 7, FD0 represents the position of the upper end position of the antenna unit 40, FD1 designates the position of the vehicle ground plane 22, FD2 depicts the position of the AM/FM terminal feeding point 51, FD3 denotes the position of the upper electrode 57 of the insulator 48, FD4 is the position of the lower electrode 57 of the insulator 48, and FD5 designates the position of the short portion 44 provided at the lower end of the coaxial feeder tube 42. Further, the distance between FD0 and FD1 is taken as la, the distance between FD1 and FD2 is taken to be lpa, the distance between FD2 and DF3 is l'dp, the distance between FD3 and FD4 is disregarded, i.e., is assumed as 0, and the distance between FD4 and FD5 is ld.

The impedance Zd' when viewing the lower-end short portion 44 side from FD4 is expressed as follows.

$$Zd' = j.Zc.\tan(\beta_{FM} ld) \ldots \quad (1)$$

where Zc is a characteristic impedance of the coaxial feeder tube 42 determined on the basis of the inner diameter a of the outer conduit tube 45 and the outer diameter b of the inner conduit tube 46*a* or 46*b* in accordance with the following equation (2):

$$Zc = \frac{1}{\sqrt{\epsilon r}} \cdot 138 \cdot \log\left[\frac{b}{a}\right] \quad (2)$$

here, $\epsilon r$ is the dielectric constant between the inner and outer conduit tubes, and $$\beta_{FM} = \frac{2\pi}{\lambda_{FM}}$$

here, $\lambda_{FM}$ represents one wavelength at the FM band center frequency.

Accordingly, when the capacity of the insulator 48 is Cd, the impedance Zd obtained when viewing the short portion 44 side from FD3 is expressed in accordance with the following equation (3):

$$Zd = Zd' = \frac{1}{j\omega_{FM} Cd} \quad (3)$$

where $\omega_{FM} = 2.\pi.f_{FM}$ ($f_{FM}$ is the FM band center frequency).

Further, the impedance Zps when viewing the short portion 44 side from FD2 through the first inner conduit tube 46*a* is given in accordance with the following equation.

$$Zps = Zc \cdot \frac{Zd + j \cdot Zc \cdot \tan(\beta_{FM} l'dp)}{Zc + j \cdot Zd \cdot \tan(\beta_{FM} l'dp)} \quad (4)$$

On the other hand, the impedance Zpa when viewing the antenna unit 40 side from FD2 through the first inner conduit tube 46*a* is given as follows.

$$Zpa = Zc \cdot \frac{Za + j \cdot Zc \cdot \tan(\beta_{FM} l'da)}{Zc + j \cdot Za \cdot \tan(\beta_{FM} l'da)} \quad (5)$$

In addition, since the length (a-b)/2 of the center axis of the AM/FM terminal 49, coming into contact with the AM/FM terminal feeding point 51, presented in the coaxial feeder tube 42 has an inductive reactance X'p corresponding thereto, when the inductance is L'p and the impedance from the input point of the AM/FM terminal 49 is ZfFM, the matching condition is as follows.

$$Zf_{FM} = j\omega_{FM} L'p + Zps//Zpa \ldots \quad (6)$$

where Zps//Zpa is the parallel impedance of Zps and Zpa.

Further, when the FM band feeder cable characteristic impedance is taken as Zo, the reflection coefficient Γ and the voltage standing wave ratio (VSWR) r are expressed in accordance with the following equations.

$$\Gamma = \frac{Zf_{FM} - Zo}{Zf_{FM} + Zo} \quad (7)$$

$$r = \frac{1 + |\Gamma|}{1 - |\Gamma|} \quad (8)$$

So as to satisfy the relation of $1 < r < a$ (a is a well-known allowable value for the matching state), parameters including the insulator 48 insertion position, coaxial feeder tube 42 total length, antenna unit 40 length outer conduit tube 45 inner diameter, and inner conduit tube 46*a* (46*b*) outer diameter are respectively selected, then the AM/FM terminal feeding point 51 position is determined.

Figure 8:
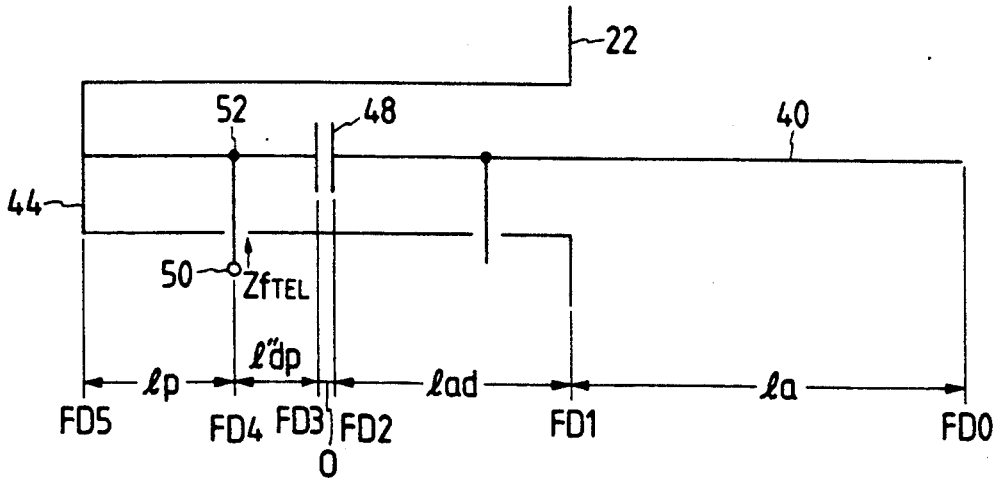

In FIG. 8, FD0 represents the position of the upper end position of the antenna unit 40, FD1 designates the position of the vehicle ground plane 22, FD2 depicts the position of the upper electrode 57 of the insulator 48, FD3 is the position of the lower electrode 57 of the insulator 48, FD4 denotes the position of the telephone terminal feeding point 52, and FD5 designates the position of the short portion 44 provided at the lower end of the coaxial feeder tube 42. Further, the distance between FD0 and FD1 is taken as la, the distance between FD1 and FD2 is taken to be lad, the distance between FD2 and DF3 is approximated to be 0, the distance between FD3 and FD4 is l''dp, and the distance between FD4 and FD5 is lp.

The impedance Zps when viewing the lower-end short portion 44 side from FD4 is expressed as follows.

$$Zps = j.Zc.\tan(\beta_{TEL} lp) \ldots \quad (9)$$

Further, the impedance Zda' when viewing the antenna unit 40 side from FD2 through the first inner conduit tube 46*a* is expressed in accordance with the following equation.

$$Zda' = Zc \cdot \frac{Za + j \cdot Zc \cdot \tan(\beta_{TEL} lad)}{Zc + j \cdot Zc \cdot \tan(\beta_{TEL} lad)} \quad (10)$$

Accordingly, when the capacity of the insulator 48 is Cd, the impedance Zda when viewing the the antenna unit 40 side from FD3 is expressed in accordance with the following equation:

$$Zda = Zda' + \frac{1}{j\omega_{TEL} Cd} \quad (11)$$

Further, the impedance Zpa when viewing the antenna unit 40 side from FD4 is given in accordance with the following equation.

$$Zpa = Zc \cdot \frac{Zda + j \cdot Zc \cdot \tan(\beta_{TEL} l' dp)}{Zc + j \cdot Zda \cdot \tan(\beta_{TEL} l' dp)} \quad (12)$$

In addition, when the length (a-b)/2 of the center axis of the telephone terminal 50, coming into contact with the telephone terminal feeding point 52, presented in the coaxial feeder tube 42 has an inductive reactance X"p corresponding thereto, the inductance is L"p and the impedance from the telephone terminal 50 input point is $Zf_{TEL}$, the matching condition is as follows.

$$Zf_{TEL} = j\omega_{TEL} L''p + Zps // Zpa \ldots \quad (13)$$

Further, when the telephone band feeder cable characteristic impedance is taken as Zo, the reflection coefficient Γ and the voltage standing wave ratio (VSWR) r are expressed in accordance with the following equations:

$$\Gamma = \frac{Zf_{TEL} - Zo}{Zf_{TEL} + Zo} \quad (14)$$

$$r = \frac{1 + |\Gamma|}{1 - |\Gamma|} \quad (15)$$

The respective parameters are selected so as to satisfy the relation of $1 < r < a$, thereby determining the position of the telephone terminal feeding point 52.

According to this embodiment, the power caused by the antenna unit 40 is fed in matching state with respect to the respective terminals 49 and 50 so as to be effectively led to the AM/FM band receiver 54 and the telephone band transceiver 55.

Figure 9:
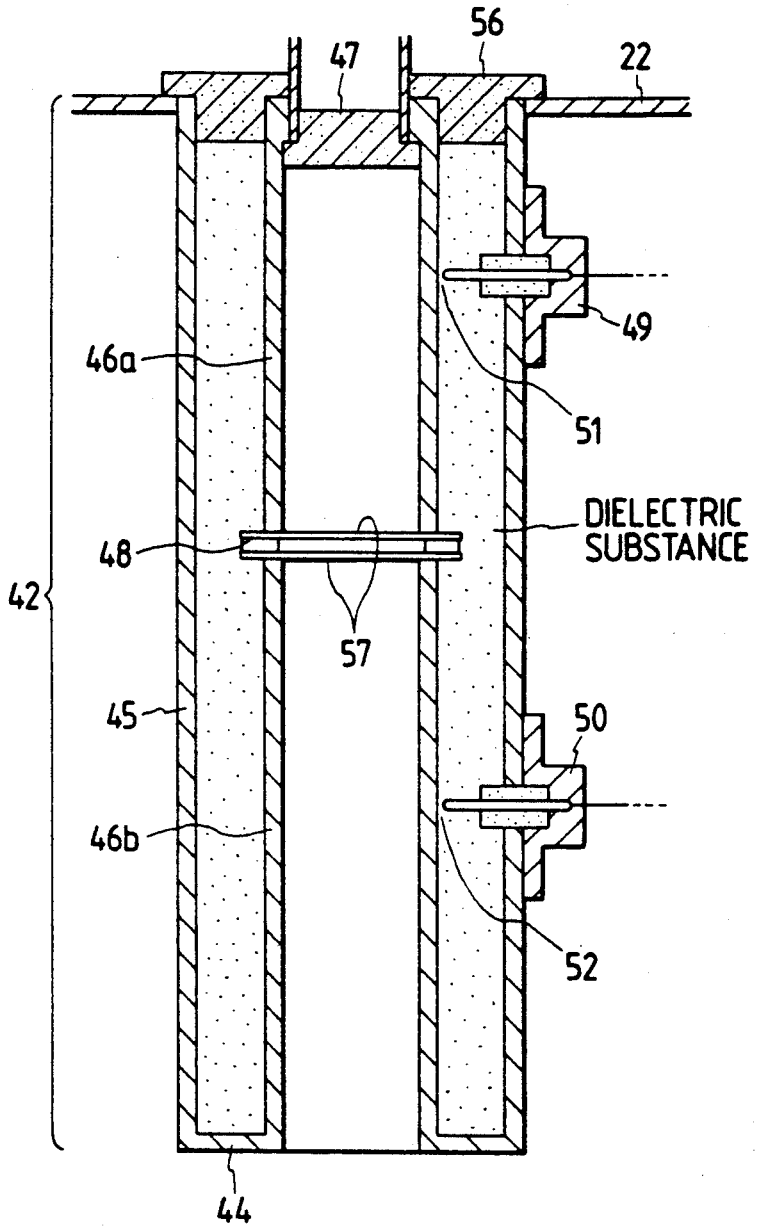
FIGS. 9 and 10 are illustrations for describing modifications of the FIG. 3 antenna system.

Here, in determining the AM/FM terminal feeding point 51 position and the telephone terminal feeding point 52 position, it is possible to freely determine the total length of the coaxial feeder tube 42 by preferentially determining the total length of the telephone terminal feeding point 52. Moreover, it is appropriate that, as illustrated in FIG. 9, a given dielectric substance having a predetermined dielectric constant is provided between the outer conduit tube 45 and the first and second inner conduit tubes 46*a*, 46*b*, whereby it is also possible to freely determine the total length of the coaxial feeder tube 42 due to the wavelength shortening effect. Further, this arrangement allows size-reduction of the system and easy encasing of the coaxial feeder tube 42 into the vehicle body.

Figure 10:
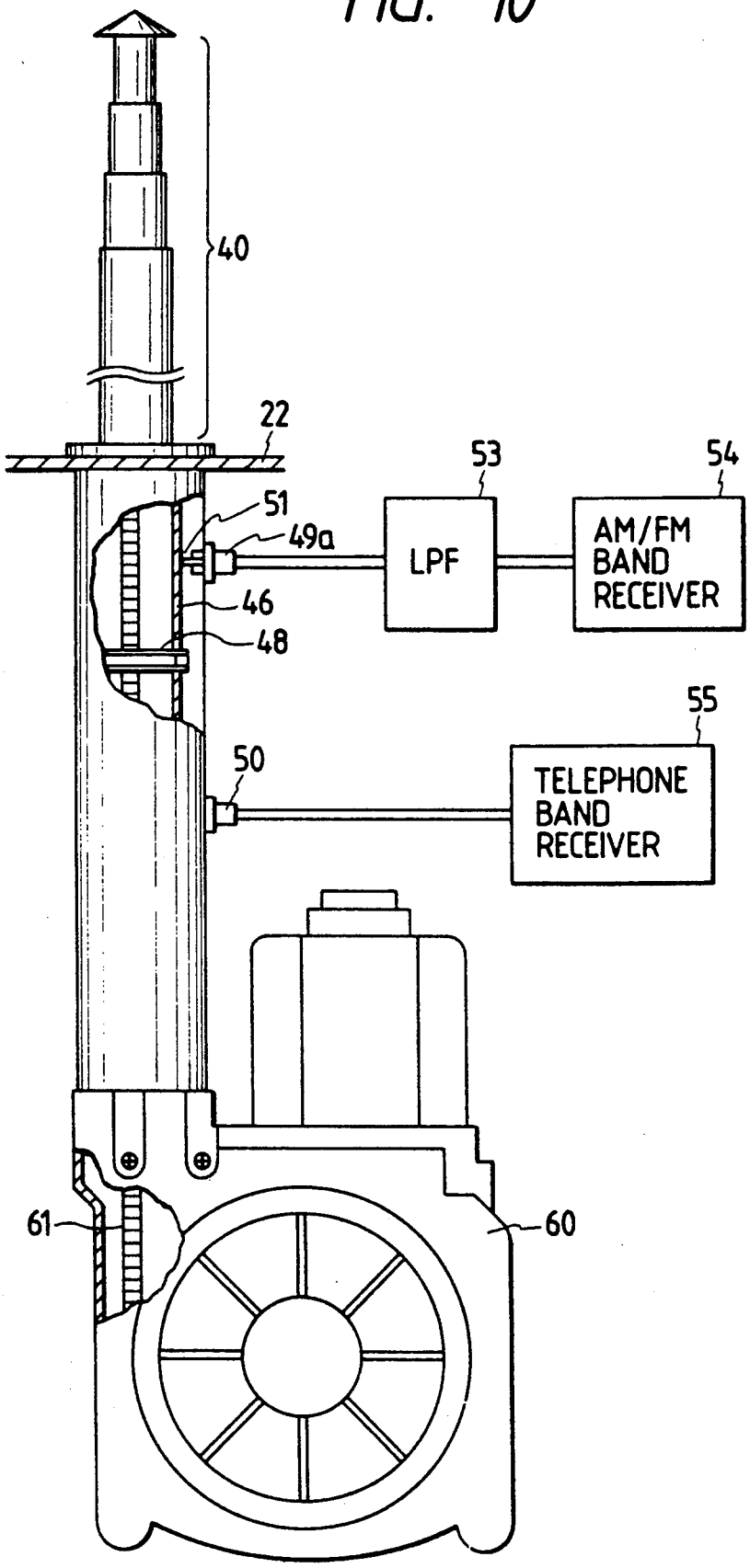

In addition, as illustrated in FIG. 10 further providing a motor driving section 60 and an antenna extension and retraction cable 61, the multiband antenna system of this embodiment can be constructed as a power telescoping multiband antenna system.

Although in this embodiment the low-pass filter 53 is provided, if adjusting the AM/FM terminal feeding point 51 position, insulator 48 position, insulator 48 capacity and other values so that the voltage standing wave ratio (VSWR) becomes infinite at the AM/FM terminal feeding point 51 position, it is possible to omit the low-pass filter 53, thereby making simple the arrangement of the multiband antenna system of this embodiment.

Moreover, in this embodiment, it is also appropriate to provide a phasing coil (phasing circuit), a trap coil (antiresonant circuit) and other devices with respect to the antenna unit 40 so as to adjust the telephone band current distribution state in the antenna unit 40 to increase the gain. Furthermore, it is possible to provide a non-grounded type antenna element such as a sleeve antenna on the upper end portion of the antenna unit 40. In this case, the feeder (coaxial cable) may be arranged to be located inside the antenna unit 40. The antenna system thus arranged can be used as a diversity antenna under the condition of using the non-grounded antenna for the telephone band communication, and further used as a four-band antenna when being used for a different band communication.

It should be understood that the foregoing relates to only preferred embodiments of the present invention, and that it is intended to cover all changes and modifications of the embodiments of the invention herein used for the purposes of the disclosure, which do not constitute departures from the spirit and scope of the invention.

What is claimed is:

1. A multiband antenna system for use in a motor vehicle, comprising:

an antenna section, which is composed of a plurality of antenna elements which are telescopically coupled to each other so as to allow extension and retraction of said antenna section, protrusively provided on said motor vehicle and having a predetermined length so as to be responsive to a first frequency band and a second frequency band different from said first frequency band;

first transmission means, which has a cylindrical and tubular configuration and is provided coaxially with respect to said antenna section, coupled to said antenna section for effecting transmission of first and second frequency signals induced by said antenna section in response to said first and second frequency bands, an inner diameter of said first transmission means being arranged to be greater than an outer diameter of said antenna section so that said first transmission means allows accommodation of said antenna section;

capacitor means provided at an end portion of said first transmission means, said capacitor means acting as a short circuit with respect to said first frequency signal and assuming a blocking state with respect to said second frequency signal;

second transmission means, which has a cylindrical and tubular configuration and is provided coaxially with respect to antenna section, coupled through said capacitor means to said first transmission means, an inner diameter of said second transmission means being greater than the outer diameter of said antenna section so that said second transmission means allows accommodation of said antenna section;

first feeding means connected to said first transmission means for deriving said second frequency signal; and second feeding means connected to said second transmission means for deriving said first frequency signal.

2. A system as claimed in claim 1, wherein said first feeding means comprises a feeding terminal to be connected to said first transmission means, a low-pass filter for deriving said second frequency signal and cutting off said first frequency signal, and a connection line having a length corresponding to one-quarter wavelength at the center frequency of said first frequency band.

3. A system as claimed in claim 2, wherein said low-pass filter includes a concentrated constant circuit comprising an inductor and a capacitor, at least one of which is adjusted to control the insertion loss of said second frequency band and the attenuation amount of said first frequency band.

4. A system as claimed in claim 1, further comprising cable means connected at its one end portion to said antenna section and a cable-driving means for operating said cable means so that said antenna section is extended and retracted so as to be protruded from and encased into said first and second transmission means.

5. A system as claimed in claim 1, wherein said capacitor means is of the type that its capacity is variable so as to adjust the insertion loss of said second frequency signal and the attenuation amount from said first frequency signal to fine-adjust the voltage standing wave ratio.

6. A system as claimed in claim 1, wherein said capacitor means is constructed by inserting a predetermined resin between surfaces of said first and second transmission means which face each other, the capacity of said capacitor means depending upon the areas of said surfaces thereof.

7. A multiband antenna system for use in a motor vehicle, comprising:

an antenna section protrusively provided on said motor vehicle and having a predetermined length so as to be responsive to a first frequency band and a second frequency band different from said first frequency band, said antenna section comprising a plurality of antenna elements which are telescopically coupled to each other so as to allow extension and retraction of said antenna section;

first transmission means electrically coupled to said antenna section for effecting transmission of first and second frequency signals induced by said antenna section in response to said first and second bands, said first transmission means having a cylindrical and tubular configuration and being provided coaxially with respect to said antenna section, an inner diameter of said first transmission means being greater than an outer diameter of said antenna section so that said first transmission means allows accommodation of said antenna section;

capacitor means provided at an end portion of said first transmission means, said capacitor means acting as a short circuit with respect to said first frequency signal and acting as an open circuit with respect to said second frequency signal;

second transmission means coupled through said capacitor means to said first transmission means, said second transmission means having a cylindrical and tubular configuration and being provided coaxially with respect to said antenna section, an inner diameter of said second transmission means being greater than an outer diameter of said antenna section so that said second transmission means allows accommodation of said antenna section;

first feeding means for deriving said second frequency signal, said first feeding means being connected to a predetermined portion of said first transmission means which allows an impedance matching with respect to said second frequency signal; and second feeding means for deriving said first frequency signal, said second feeding means being connected to a predetermined portion of said second transmission means which allows an impedance matching with respect to said first frequency signal.

8. A system as claimed in claim 7, wherein said first feeding means comprises a feeding terminal to be connected to said first transmission means, a low-pass filter for deriving said second frequency signal and cutting off said first frequency signal, and a connection line having a length corresponding to one-quarter wavelength at the center frequency of said first frequency band.

9. A system as claimed in claim 8, wherein said low-pass filter includes a concentrated constant circuit comprising an inductor and a capacitor, at least one of which is adjusted to control the insertion loss of said second frequency band and the attenuation amount of said first frequency band.

10. A system as claimed in claim 7, further comprising cable means connected at its one end portion to said antenna section and a cable-driving means for operating said cable means so that said antenna section is extended and retracted so as to be protruded from and encased into said first and second transmission means.

11. A system as claimed in claim 7, wherein said capacitor means is of the type that its capacity is variable so as to adjust the insertion loss of said second frequency signal and the attenuation amount from said first frequency signal to fine-adjust the voltage standing wave ratio.

12. A system as claimed in claim 7, wherein said capacitor means is constructed by inserting a predetermined resin between surfaces of said first and second transmission means which face each other, the capacity of said capacitor means depending upon the areas of said surfaces thereof.

13. A multiband antenna system for use in a motor vehicle, comprising:

an antenna section, which comprises a plurality of antenna elements which are telescopically coupled to each other so as to allow extension and retraction of said antenna section, provided on said motor vehicle and having a predetermined length so as to be responsive to a first frequency band and a second frequency band different from said first frequency band;

a first conduit tube electrically coupled to said antenna section for effecting transmission of first and second frequency signals induced by said antenna section in response to said first and second bands, an inner span of said first conduit tube being greater than an outer diameter of said antenna section so that said first conduit tube allows accommodation of said antenna section;

capacitor means provided at an end portion of said first conduit tube, said capacitor means acting as a short circuit with respect to said first frequency signal and acting as an open circuit with respect to said second frequency signal;

a second conduit tube coupled through said capacitor means to said first conduit tube, an inner span of said second conduit tube being greater than an outer diameter of said antenna section so that said second conduit tube allows accommodation of said antenna section;

a third conduit tube electrically coupled to a body of said motor vehicle and having at least a length equal to a sum of the lengths of said first and second conduit tubes, said first and second conduit tubes being encased in said third conduit tube in spaced relation to each other;

first feeding means connected to said first conduit tube for deriving said frequency signal; and second feeding means connected to said second conduit tube for deriving said first frequency signal.

14. A system as claimed in claim 13, wherein the space formed between said first and second conduit tubes and said third conduit tube is filled with a dielectric substance having a predetermined dielectric constant.

* * * * *